US007047664B1

(12) United States Patent
Martinez

(10) Patent No.: US 7,047,664 B1
(45) Date of Patent: May 23, 2006

(54) AIR BLOWER TO REMOVE LINT FROM DRYER DUCTING

(76) Inventor: Ruben E. Martinez, 6176 Natalie Rd., Chino Hills, CA (US) 91709

( * ) Notice: Subject to any disclaimer, the term of this patent is extended or adjusted under 35 U.S.C. 154(b) by 0 days.

(21) Appl. No.: 10/981,040

(22) Filed: Nov. 5, 2004

(51) Int. Cl.
*F26B 7/00* (2006.01)

(52) U.S. Cl. ..... 34/380

(58) Field of Classification Search ..... 34/312, 34/318, 326, 380, 82, 85, 14
See application file for complete search history.

(56) References Cited

U.S. PATENT DOCUMENTS

| | | | | |
|---|---|---|---|---|
| 1,935,158 | A * | 11/1933 | Lumley | 15/319 |
| 2,825,148 | A | 3/1958 | Olson | 34/75 |
| 2,836,256 | A * | 5/1958 | Caskey | 55/293 |
| 3,215,560 | A | 11/1965 | Kredit | 134/21 |
| 4,700,492 | A | 10/1987 | Werner et al. | |
| 4,922,808 | A | 5/1990 | Smith | |
| 5,003,998 | A | 4/1991 | Collett | |
| 5,155,924 | A * | 10/1992 | Smith | 34/443 |
| 5,555,643 | A * | 9/1996 | Guasch | 34/443 |
| 5,628,122 | A | 5/1997 | Spinardi | |
| 5,960,556 | A * | 10/1999 | Jansen | 34/402 |
| 6,016,610 | A | 1/2000 | Sears | |
| 6,754,976 | B1 * | 6/2004 | Edwards | 34/140 |
| 2002/0023368 | A1 | 2/2002 | Beaumont | |

OTHER PUBLICATIONS www.airqualitycontrollers.com article reprinted from DUCTALES dated Sep./Oct. 1999 entitled An Unseen Danger to Consumers by Jason Doyle.*

* cited by examiner

*Primary Examiner*—S. Gravini
(74) *Attorney, Agent, or Firm*—Kenneth L. Green; Edgar W. Averill, Jr.

(57) ABSTRACT

A system and method for blowing lint from clothing dryer exhaust ducting. The system includes a high capacity electric blower, an adapter to connect the blower to a dryer exhaust hook-up, and a lint catcher to capture lint blown from the ducting. The lint catcher may be connected over an exterior wall vent, or to a portion of the ducting exposed in an attic. The method includes removing a flexible dryer exhaust hose from the exhaust hook-up, connecting the adapter between the blower and the wall hook-up, connected the catcher to the exterior vent or to the exposed ducting, and running the blower.

8 Claims, 5 Drawing Sheets

AIR BLOWER TO REMOVE LINT FROM DRYER DUCTING

BACKGROUND OF THE INVENTION

The present invention relates to removing lint from ducting and in particular to a system and method for blowing lint out of clothing dryer exhaust ducting.

Most homes include indoor washer and dryer connections. The dryer connections may be for an electric dryer, thus including a high wattage electrical outlet, or for a gas dryer, thus including a gas outlet, and a drying exhaust hook-up for both electric and gas dryers. The dryer exhaust hook-up generally protrudes from a wall behind the dryer location to allow a flexible hose to be connected between the dryer and the hook-up. The hook-up is generally about four inches in diameter, and the ducting runs from the hook-up, through walls and/or ceiling and/or attic to a outside vent. The vent may be on an exterior wall, or though the roof.

The ducting may include vertical portions, a number of bends, and may run as long as 50 feet. Although dryers include lint traps, screens, and/or filters, some lint escapes the dryer into the ducting. Because of the length, turns, vertical climbing sections, and joints, some of the lint which escapes the dryer becomes lodged in the ducting. Due to the heat and dryness of the lint, a potential for causing fires results, and such fires have occurred.

Therefore, there is a need for a system and method for removing lint from clothing dryer exhaust ducting.

BRIEF SUMMARY OF THE INVENTION

The present invention addresses the above and other needs by providing a system and method for blowing lint from clothing dryer exhaust ducting. The system includes a high capacity electric blower, an adapter to connect the blower to a dryer exhaust hook-up on a laundry room wall, and a lint catcher to capture lint blown from the ducting. The lint catcher may be connected over an exterior wall vent, or to a portion of the ducting exposed, for example, in an attic. The method includes removing a flexible dryer exhaust hose from the exhaust hook-up, connecting the adapter between the blower and the dryer exhaust hook-up, connected the catcher to the exterior vent or to the exposed ducting, and running the blower.

In accordance with one aspect of the invention, there is provided a method for cleaning clothing dryer exhaust ducting. The method comprises connecting a hook-up end of an adapter to a clothing dryer exhaust hook-up, connecting a blower end of the adapter to a blower, connecting a catcher to a distal point of the ducting, and blowing air through the ducting. Connecting the catcher may comprise either connecting the catcher to a wall vent using a catcher hood, or to an exposed section of ducting using a mating section.

In accordance with another aspect of the invention, there is provided a system for cleaning in-wall ducting. The system comprises a blower and an adapter. The blower preferably is a 1,500 Cubic Feet per Minute (CFM) to 4,000 CFM blower, and may be, for example, a carpet drying blower. The blower is more preferably a 2,000 CFM to 3,000 CFM blower, and most preferably, an approximately 3,000 CFM blower. The adapter has a blower end and a wall (or dryer) hook-up end, which wall hook-up end is adapted to connect to a standard approximately four inch diameter dryer exhaust hook-up, and preferably has an inside diameter of approximately four inches. A catcher is preferably provided to attach to a distal point of the ducting to catch material blown out of the ducting. The catcher is preferably mounted to a wall vent, or in the case of a roof vent, the catcher is preferably connected to a section of the ducting in an attic. The adapter further preferably includes at least a blower flange for connecting to the blower, a tapered adapter for reducing the diameter of the adapter from about ten inches to about four inches, a swivel elbow for aligning the adapter with the hook-up, and a hook-up adapter for connecting the adapter to the dryer exhaust hook-up.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
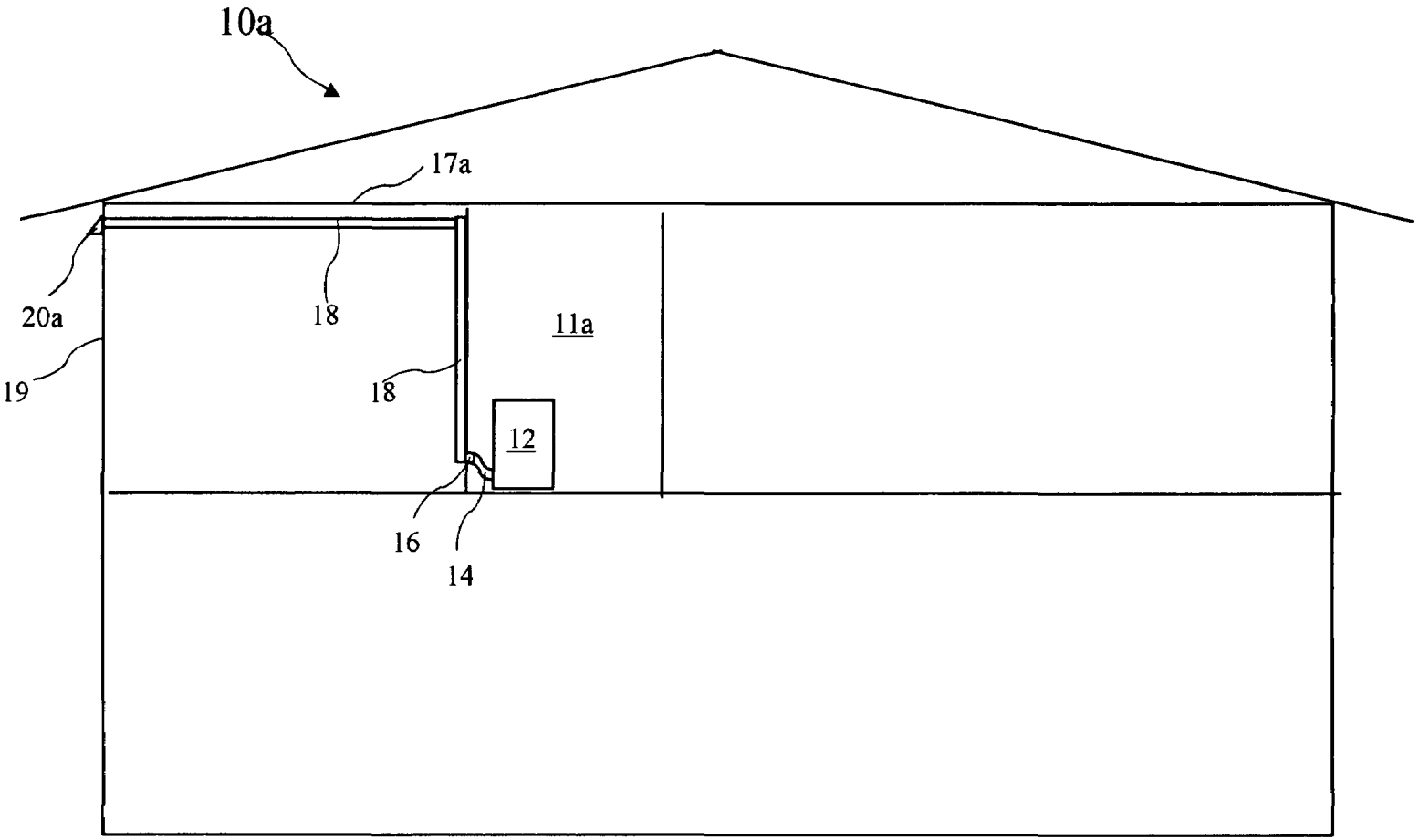
FIG. 1A is a first house having an indoor second floor laundry room with ducting in a second floor ceiling, the ducting connecting a clothes dryer exhaust hook-up to a wall vent on an exterior wall of the house.

A first house 10*a* having a second floor indoor laundry room 11*a* is shown in FIG. 1A. Ducting 18 running through a second floor ceiling 17*a* connects a clothes dryer exhaust hook-up 16 in the laundry room 11*a* to a wall vent 20*a* on an exterior wall 19 of the house 10*a*. A clothes dryer 12 is connected by a flexible hose 14 to the hook-up 16. When the clothes dryer 12 is in operation, exhaust from the dryer 12 is carried by the ducting 18 to the wall vent 20*a*. The exhaust is primarily heated air, but although clothes dryers 12 include lint traps, some lint nearly always escapes into the exhaust. The lint is often caught by some feature inside the ducting 18, and over a period of time, a great deal of lint may be accumulated inside the ducting 18. The accumulation of lint may both reduce the efficiency of the clothes dryer 12 by reducing the exhaust flow, and may create a fire hazard.

Figure 1B:
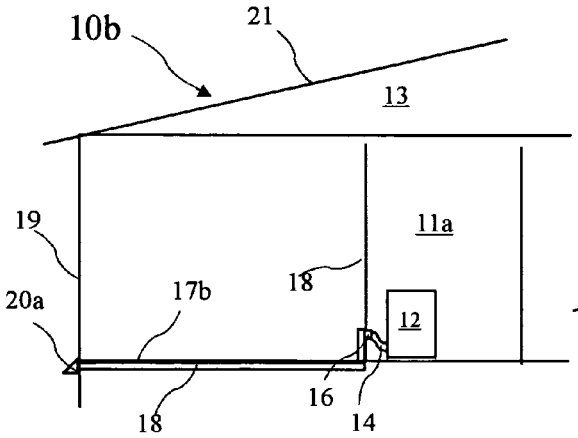
FIG. 1B is a partial view of a second house having a second floor indoor laundry room with ducting in a first floor ceiling, the ducting connecting the clothes dryer exhaust hook-up to a wall vent on an exterior wall of the house.

A partial view of a second house 10*b* having the second floor indoor laundry room 11*a*, with ducting 18 in a first floor ceiling 17*b*, is shown in FIG. 1B. The ducting 18 connects the clothes dryer exhaust hook-up 16 to the wall vent 20*a* on the exterior wall 19 of the house 10*b*.

Figure 1C:
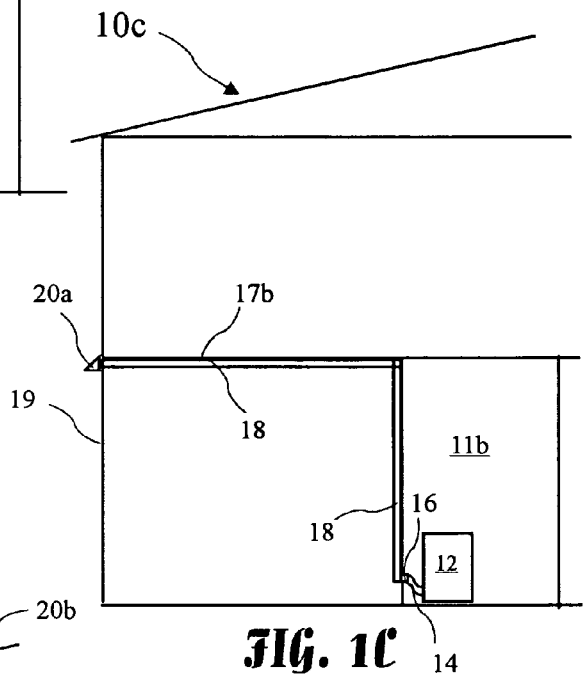
FIG. 1C is a partial view of a third house having a first floor indoor laundry room with ducting in a first floor ceiling, the ducting connecting the clothes dryer exhaust hook-up to a wall vent on an exterior wall of the house.

A partial view of a third house 10*c* having a first floor indoor laundry room 11*b*, and ducting 18 in a first floor ceiling 17*b*, is shown in FIG. 1C. The ducting 18 connects the clothes dryer exhaust hook-up 16 to the wall vent 20*a* on the exterior wall 19 of the house 10*c*.

Figure 1D:
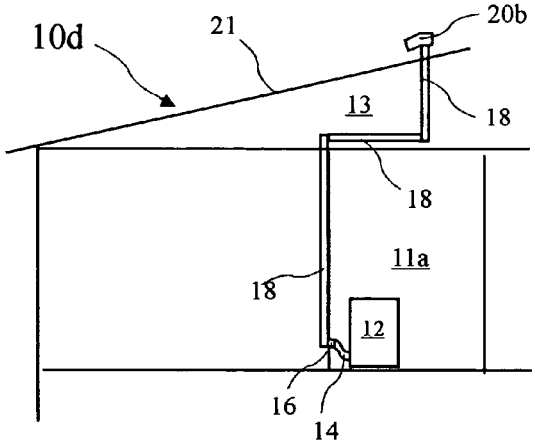
FIG. 1D is a partial view of a fourth house having a second floor indoor laundry room with ducting connecting the clothes dryer exhaust hook-up to a roof vent on a roof of the house.

A partial view of a fourth house 10*d* is shown in FIG. 1D. The house 10*d* has a roof vent 20*b* residing on a roof 21. The clothes dryer exhaust hook-up 16 is connected to the roof vent 20*b* by the ducting 18 running through an attic 13. The recent interest in centrally located upstairs laundry rooms 11 has increased the occurrence long runs of ducting 18 from clothes dryers 12 to exterior vents 20*a* and 20*b*.

Figure 2A:
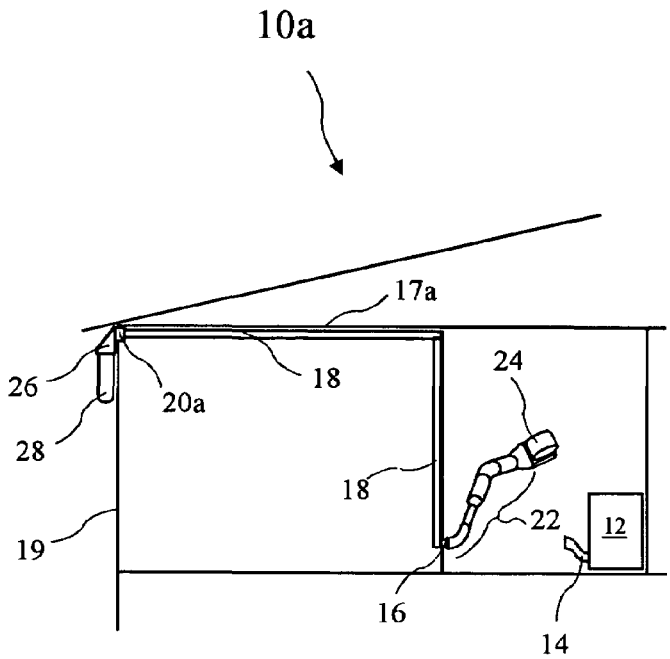
FIG. 2A depicts a blower system according to the present invention attached to the clothes dryer exhaust hook-up, with a catcher connected to the wall vent.

A blower system according to the present invention is shown attached to the clothes dryer exhaust hook-up 16 in FIG. 2A. The flexible hose 14 is disconnected from the hook-up 16 and the clothes dryer 12 is moved away from the hook-up 16. A blower 24 is connected to the hook-up 16 by an adapter 22. A catcher 28 is shown connected to the wall vent 20*a* by a catcher hood 26. After the ducting 18 has been cleaned, the catcher hood 26 may be removed.

The blower 24 preferably is a 1,500 Cubic Feet per Minute (CFM) to 4,000 CFM blower, and may be, for example, a carpet drying blower. The blower is more preferably a 2,000 CFM to 3,000 CFM blower, and most preferably, an approximately 3,000 CFM blower. An example of a suitable blower 24 is the Air Mover blower manufactured by Diamondback manufacturing in Pueblo, Colo. The preferred range between 1,500 CFM and 4,000 CFM provides sufficient flow to clean most ducting, while not damaging the ducting. Carpet blowers are commonly available which have variable flow between 2,000 CFM and 3,000 CFM, thus making blowers economically available in that range of flow. A single flow of 3,000 CFM is desirable in that such flow is more than sufficient for most ducting, and is well below a damaging flow.

Figure 2B:
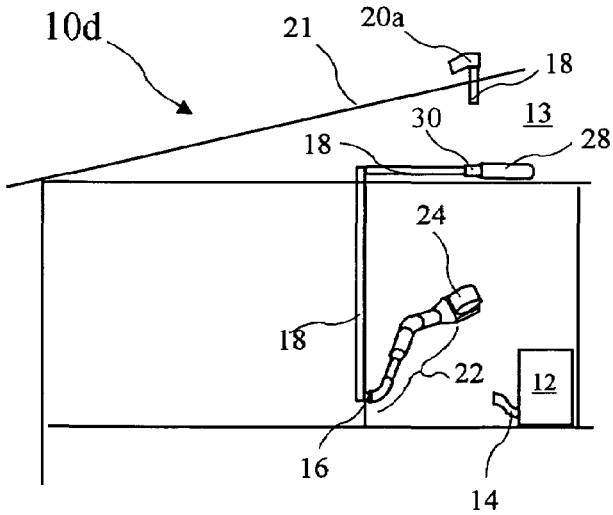
FIG. 2B depicts the blower system according to the present invention attached to the clothes dryer exhaust hook-up, with the catcher connected to a section of the ducting leading to the roof vent.

The blower system according to the present invention is shown attached to the clothes dryer exhaust hook-up 16, with the catcher 28 connected to a section of the ducting 18 leading to the roof vent 20*b*, in FIG. 2B. Sections of the ducting 18 are separated in the attic 13, and a mating section 30 is attached to the exposed ducting section leading to the hook-up 16. The catcher 28 is connected to the mating section 30 to collect lint and the like blown out of the ducting 18 by the blower 24.

Figure 3:
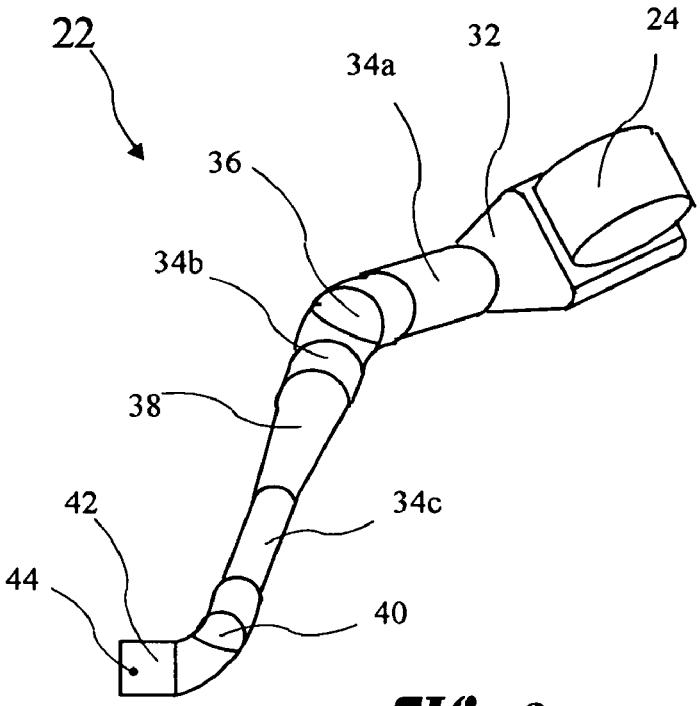
FIG. 3 shows a detailed view of an adapter used to connect the blower to the clothes dryer exhaust hook-up.

A detailed view of the adapter 22 used to connect the blower 24 to the clothes dryer exhaust hook-up 16 (see FIGS. 2A and 2B) is shown in FIG. 3. The adapter 22 includes a blower flange 32 to connected the blower 24 to the adapter 22. In the case of the Air Mover blower, the blower flange 32 includes an approximately four inch by seventeen inch oval mouth to attach to the blower 24. The blower flange 32 may be attached to the blower 24 in a variety of ways including clamps, vice grips, screws, etc. and is preferably attached using ¼ inch machine bolts. The blower flange 32 connects to an approximately ten inch diameter first straight section 34*a*. The straight section 34*a* attached to a swivel elbow 36 which is swivelable between straight, and a 90 degree bend. The elbow 36 is connected to an approximately ten inch diameter second straight section 34*b*. The straight section 34*b* is connected to a tapered adapter 38 which tapers from approximately ten inches in diameter to a smaller diameter to reduce the adapter size to approximately the size of the hook-up 16, for example to approximately four inches in diameter. The smaller end of the tapered adapter 38 is connected to a third straight section 34*c*. The straight section 34*c* is connected to a small swivel elbow 40, and the elbow 40 is connected to a hook-up adapter 42. The hook-up adapter 42 may be attached to the hook-up 16, for example, by drilling two holes in the hook-up 16 and screwing two hook-up screws 44 through the hook-up adapter 42 and into the hook-up 16.

The adapter 22 described in FIG. 3 provides for adjustment to fit a variety of laundry rooms. A much simpler adapter, for example the blower flange 32, tapered adapter 38, elbow 40, and hook-up adapter 42 may be sufficient in many instances, and a blower system including any adapted to connect the blower 24 to the hook-up 16 is intended to come within the scope of the present invention. After cleaning the ducting 18, the adapter 22 is removed from the hook-up 16, and the flexible hose 14 reattached, thus covering the holes used to mount the hook-up adapter 42 to the hook-up 16.

Figure 4:
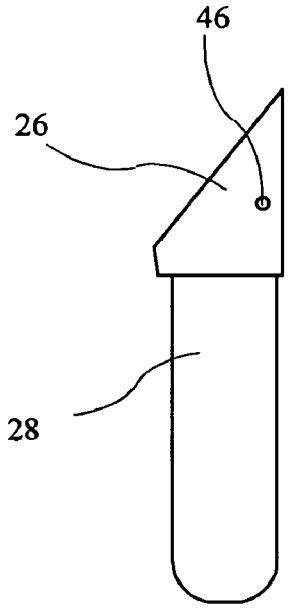
FIG. 4 is a catcher hood and catcher suitable to attach to the wall vent.

A detailed view of the catcher hood 26 and the catcher 28 suitable to attach to the wall vent 20*a* is shown in FIG. 4. The wall vent 20*a* is frequently sloped downward and away from the house 10*a* to prevent material from accumulating on top of the wall vent 20*a*. The catcher hood 26 preferably has a shape similar to the wall vent 20*a*, and is attached over the wall vent 20*a* by vent screws 46. For example, two holes may be drilled in the wall vent 20*a*, guided by holes in the catcher hood 26. The vent screws 46 may then pass through the catcher hood 26 and be screwed into the wall vent 20*a* to attach the catcher hood 26 to the wall vent 20*a*. Other methods such a clamping, hooking, temporarily glueing, etc., may be used to attach the catcher hood 26 to the wall vent 20*a*, and a blower system using any means to attach a catcher to a wall vent is intended to come within the scope of the present invention. Following cleaning the ducting 16, the catcher hood 26 is removed, and the holes drilled in the wall vent 20*a* are preferably filled, preferably by silicone, putty, screws, or pop-rivets, and more preferably by pop-rivets covered by silicone or by silicone alone.

Figure 5:
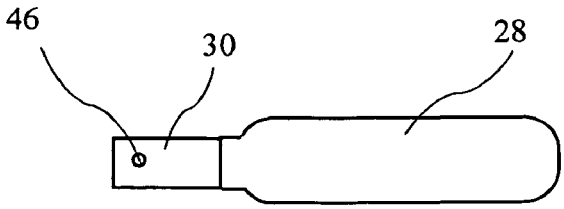
FIG. 5 is a mating section and catcher suitable to connect to a section of the ducting leading to the roof vent.

A detailed view of the mating section 30 and catcher 28 suitable to connect to a section of the ducting 18 leading to the roof vent 20*b* is shown in FIG. 5. The mating section 30 connects to the ducting 18 after a section of the ducting 18 is moved, and is preferably attached to a horizontal section of the ducting 18 in the attic 13 (see FIG. 2D). The mating section 30 may attached to the ducting 18 using the vent screws 46.

Figure 6:
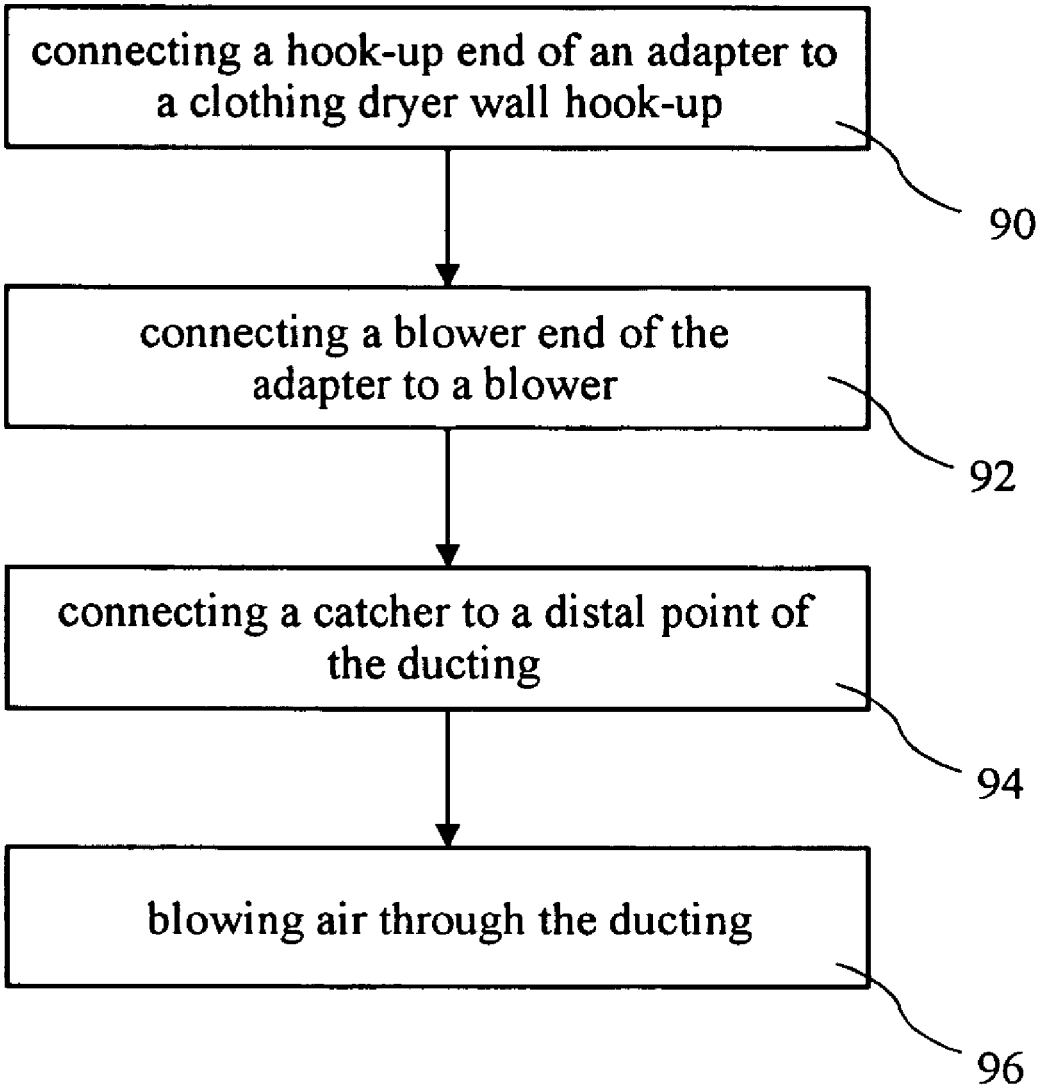
FIG. 6 describes a method for cleaning ducting according to the present invention.

FIG. 6 describes a method for cleaning ducting according to the present invention. The method includes the steps of connecting a hook-up end of an adapter to a clothing dryer wall hook-up at step 90, connecting a blower end of the adapter to a blower at step 92, connecting a catcher to a distal point of the ducting at step 94, and blowing air through the ducting at step 96. The step of connecting a catcher may either comprise connecting a catcher to a wall vent, or to a section of ducting leading to a vent.

While the invention herein disclosed has been described by means of specific embodiments and applications thereof, numerous modifications and variations could be made thereto by those skilled in the art without departing from the scope of the invention set forth in the claims.

I claim:

1. A method for cleaning clothing dryer ducting in a house, the method comprising:

moving the clothing dryer away from a wall if necessary to gain access to a clothing dryer exhaust hook-up;

disconnecting a flexible hose from the exhaust hook-up, wherein the exhaust hook-up generally protrudes from the wall behind a clothing dryer location to allow the flexible hose to be connected between the clothing dryer and the exhaust hook-up;

connecting a hook-up end of an adapter to the exhaust hook-up;

connecting a blower end of the adapter to a blower through a blower flange, wherein the adapter includes at least:

the blower flange for connecting to the blower;

a tapered adapter for reducing the diameter of the adapter;

a swivel elbow for aligning the adapter with the exhaust hook-up; and the hook-up end for connecting the adapter to the exhaust hook-up;

attaching a catcher over a wall vent on the exterior of the house, wherein the catcher includes a catcher hood shaped to reside over the wall vent, and wherein dryer exhaust ducting connects the exhaust hook-up to the wall vent;

using the blower to blow air through the dryer exhaust ducting to move lint inside the dryer exhaust ducting towards the wall vent;

catching the lint blown from the dryer exhaust ducting using the catcher; and removing the catcher after blowing the lint from the duct.

2. The method of claim 1, wherein connecting a blower end of the adapter to a blower comprises connecting the blower end of the adapter to the blower wherein the adapter is about four inches in diameter at the hook-up end.

3. The method of claim 2, wherein connecting a blower end of the adapter to a blower comprises connecting the blower end of the adapter to the blower wherein the adapter reduces from about ten inches at the blower end to about four inches at the hook-up end.

4. The method of claim 1, wherein connecting a blower end of the adapter to a blower through the blower flange comprises connecting the blower end of the adapter to the blower through the blower flange using at least one fastener selected from the group consisting of clamps, vice grips, screws, and machine bolts.

5. The method of claim 1, wherein attaching a catcher over a wall vent comprises attaching the catcher over the wall vent using a fastening method selected from the group consisting of clamping, hooking, and temporarily glueing.

6. The method of claim 1, wherein removing the catcher comprises removing the catcher from the wall vent using an unfastening method selected from the group consisting of unclamping, unhooking, and unglueing the catcher from the wall vent.

7. A method for cleaning clothing dryer ducting in a house, the method comprising:

moving the clothing dryer away from a wall if necessary to gain access to a clothing dryer exhaust hook-up disconnecting a flexible hose from the exhaust hook-up, wherein the exhaust hook-up generally protrudes from the wall behind a clothing dryer location to allow the flexible hose to be connected between the clothing dryer and the exhaust hook-up;

connecting a hook-up end of an adapter to the exhaust hook-up;

connecting a blower end of the adapter to a blower through a blower flange, wherein the adapter includes at least:

the blower flange for connecting to the blower;

a tapered adapter for reducing the diameter of the adapter;

a swivel elbow for aligning the adapter with the exhaust hook-up; and the hook-up end for connecting the adapter to the exhaust hook-up;

disassembling a section of dryer exhaust ducting inside the house to expose an open end of the dryer exhaust ducting leading to the exhaust hook-up;

attaching a catcher over the open end of the dryer exhaust ducting and wherein the dryer exhaust ducting normally connects the exhaust hook-up to a wall vent;

using the blower to blow air through the dryer exhaust ducting to move lint inside the dryer exhaust ducting towards the catcher;

catching the lint blown from the dryer exhaust ducting using the catcher; and removing the catcher after blowing the lint from the duct.

8. The method of claim 7, wherein disassembling a section of dryer exhaust ducting inside the house comprises disassembling the section of the dryer exhaust ducting inside an attic of the house.

* * * * *